United States Patent [19]

Hernandez

[11] 4,164,097

[45] Aug. 14, 1979

[54] OPTICAL LENS GRINDER DEVICE

[76] Inventor: Walter Hernandez, 4650 E. 10 Ct., Hialeah, Fla. 33013

[21] Appl. No.: 903,701

[22] Filed: May 8, 1978

[51] Int. Cl.[2] ..... B24B 9/14

[52] U.S. Cl. ..... 51/101 LG; 74/569; 409/79; 409/147

[58] Field of Search ..... 51/101 R, 101 LG, 284 E, 51/165.79, 93; 74/569; 90/13 B, 13.9

[56] References Cited

U.S. PATENT DOCUMENTS

| | | | |
|---|---|---|---|
| 1,269,680 | 6/1918 | Bugbee | 51/101 LG |
| 3,513,598 | 5/1970 | Asselin et al. | 51/101 LG |
| 3,673,738 | 7/1972 | Stern | 51/101 LG |
| 3,738,064 | 6/1973 | Szyferblatt | 51/101 LG |
| 3,745,720 | 7/1973 | Savage | 51/101 LG |
| 3,798,844 | 3/1974 | Hannaman | 51/101 LG |
| 3,894,361 | 7/1975 | Georgiadis et al. | 51/101 LG |
| 4,003,165 | 1/1977 | Saun | 51/101 LG |

FOREIGN PATENT DOCUMENTS

| | | | |
|---|---|---|---|
| 1420502 | 1/1976 | United Kingdom | 51/101 LG |

*Primary Examiner*—Harold D. Whitehead
*Assistant Examiner*—K. Bradford Adolphson

[57] ABSTRACT

An optical lens grinder device including a main base and a lens carriage pivotally slidably connected along one edge to the base. A first motor mounted on the base drives a pair of closely spaced apart grinder wheels, one for shaping and sizing a lens blank, the other for peripherally beveling the edges thereof. Lens blanks to be ground are pneumatically clamped in a chuck and rotated by a second motor mounted to the lens carriage; and a cam arrangement connecting between the base and lens carriage moves a lens clamped in the chuck, sequentially and in a timed relation, over the first grinder wheel, lowers it for shaping and sizing thereon in conformity with a lens template fixed to the chuck drive shaft, pivots the lens carriage with the lens upwardly out of engagement with the first grinder wheel, moves the lens carriage laterally to position the lens over the second or beveling grinder, lowers the lens into engagement with the beveling grinder for the beveling operation, after which the lens carriage pivots the finished lens upwardly for removal from the chuck.

31 Claims, 11 Drawing Figures

OPTICAL LENS GRINDER DEVICE

BACKGROUND OF THE PRESENT INVENTION

The present invention pertains to optical lens grinder devices and more particularly to a lens grinder device which sequentially and in a timed relation automatically produces a finished lens, shaped and sized in conformity with a lens template, in less than one minute, approximately 48 seconds for example.

Optical lens grinders currently in commercial use are very expensive, ranging upwardly close to $10,000 at the present time. The device of the present invention accomplishes its purpose at least as well as and generally better than the presently used devices because of its extreme simplicity in structure as compared with the great complexity of other existing lens grinders. According to present estimates, the device of the present invention will sell for substantially less than one-half the cost of the lowest priced machine of this type currently in use up to almost one-fourth the price of the most costly machine.

Therefore, one of the principal objects of the present invention is to provide an optical lens grinder device which provides a lens carriage with a motor driven chuck to engage and firmly hold a lens blank and whereby the operation of a single cycle start switch will activate the device to shape, size and bevel an optical lens blank in conformity with a template carried on an extended end of the chuck shaft.

A further principal object of the invention is to provide an optical lens grinder which employs a very unique and single cam assembly comprised of an appropriately configurated cam plate and a rotating arm with an angularly disposed cam follower on each end to, first, move the lens carriage to position the lens blank over a first, edge grinding wheel to shape and size the lens, to, second, raise the carriage to move the sized and shaped lens from engagement with the first grinder, to, third, shift the lens over a second, beveling grinder wheel, to, fourth, lower the carriage to move the lens edge into engagement with the beveling grinder, and, fifth, to raise the carriage with the lens upwardly to a start position for the next cycle for removal of the finished lens, the complete uninterrupted cycle being accomplished in approximately 48 seconds.

Another important object of the instant invention is to provide an adjustable cone and follower means to compensate for the constant lateral deviation of the peripheral edge of the lens in grinding the bevel, the deviation being due to the everchanging depth of the cut toward or away from the central or optical axis of the lens blank and the semi-spherical configuration of the lens blank.

DETAILED DESCRIPTION OF A PREFERRED EMBODIMENT

Figure 1:
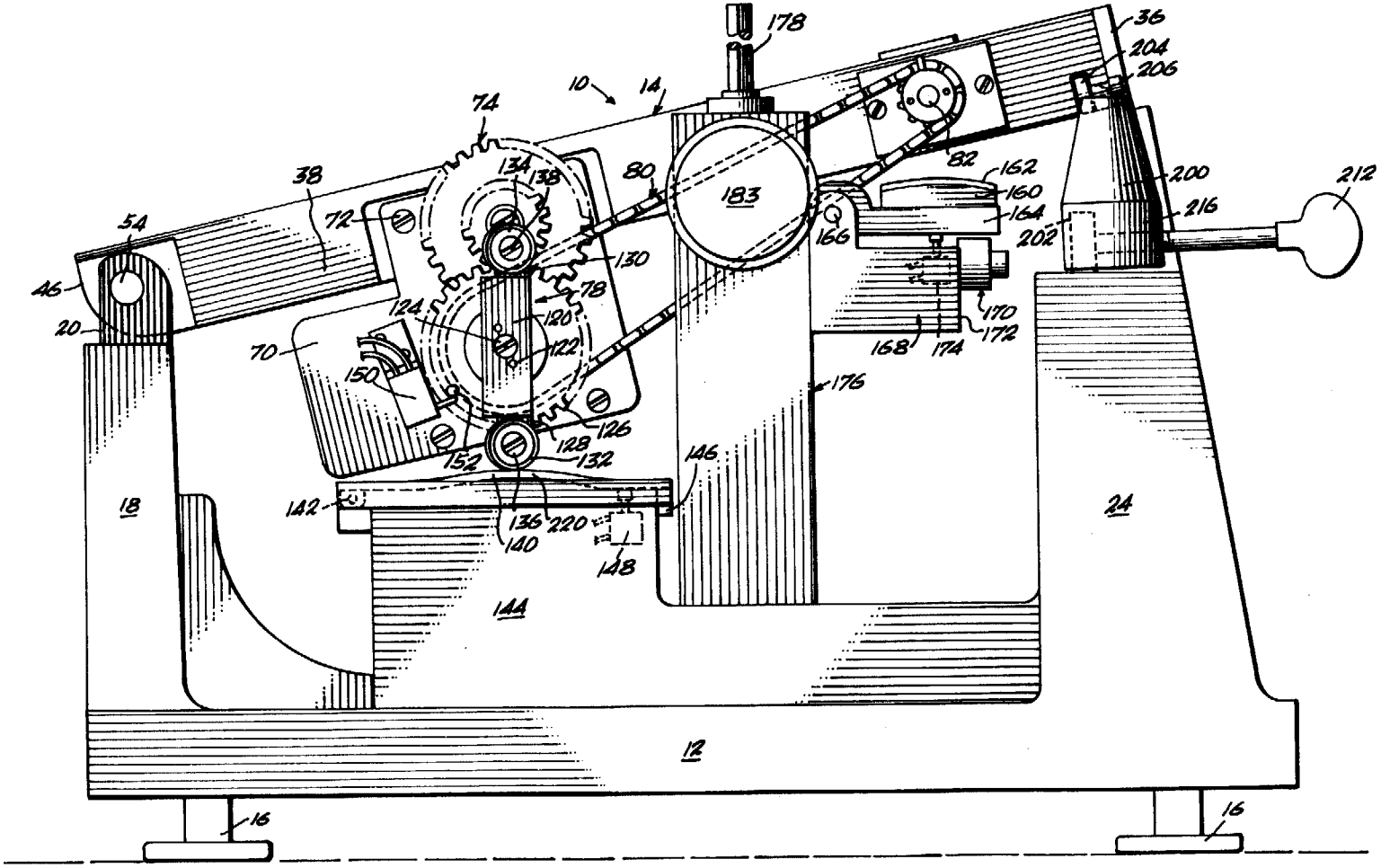
FIG. 1 is a side elevational view of the optical lens grinder of the present invention.
Figure 2:
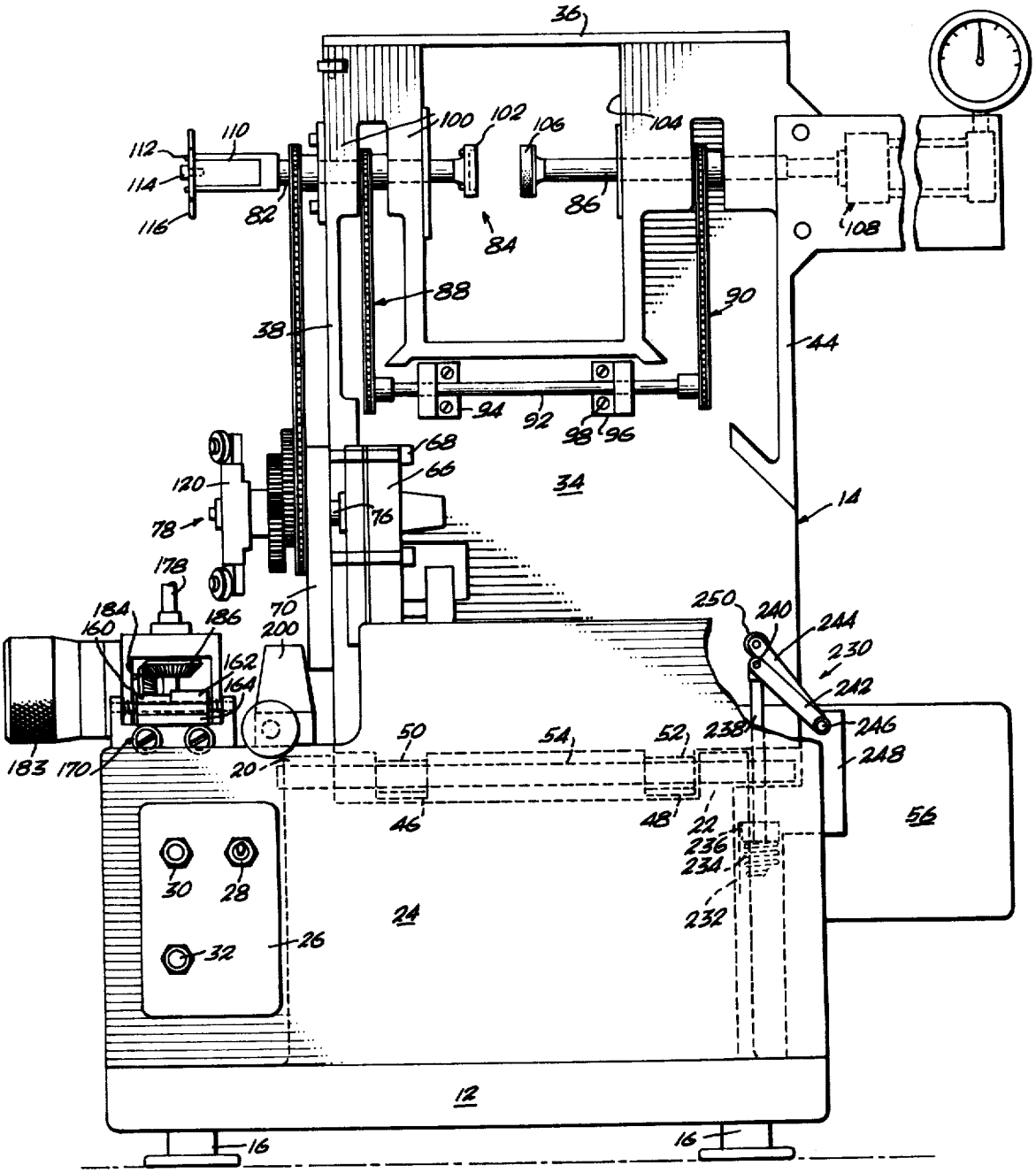
FIG. 2 is a front end view of the device with the top lens carriage plate pivoted upwardly to an open position.

With reference to the drawings in which like reference characters designate like or corresponding parts throughout the various views and with particular reference to FIGS. 1 and 2 the optical lens grinder device of the present invention, designated generally at 10, includes a main base portion 12 and a lens carriage 14. Base 12 is provided with a support 16 at each corner and an upstanding rear end portion 18 with a pair of ears 20, 22 extending upwardly from the respective side edge portions thereof. A generally upstanding front wall 24 carries a control panel 26 provided with a main on-off switch 28, a cycle start switch 30 and an air cylinder control switch 32.

The lens carriage 14 comprises a large top plate 34 with front and side skirts 36, 38, 44 and a pair of rearwardly extending bosses 46, 48 provided with respective bushings 50, 52 for pivotal and lateral sliding movement on a rod 54, fixed between ears 20, 22. As illustrated in FIG 2, the relative spacing between bosses 46, 48 and ears 20, 22 permits a predetermined amount of lateral movement of the carriage 14 along rod 54 as well as up and down pivotal movement thereon.

Figure 3:
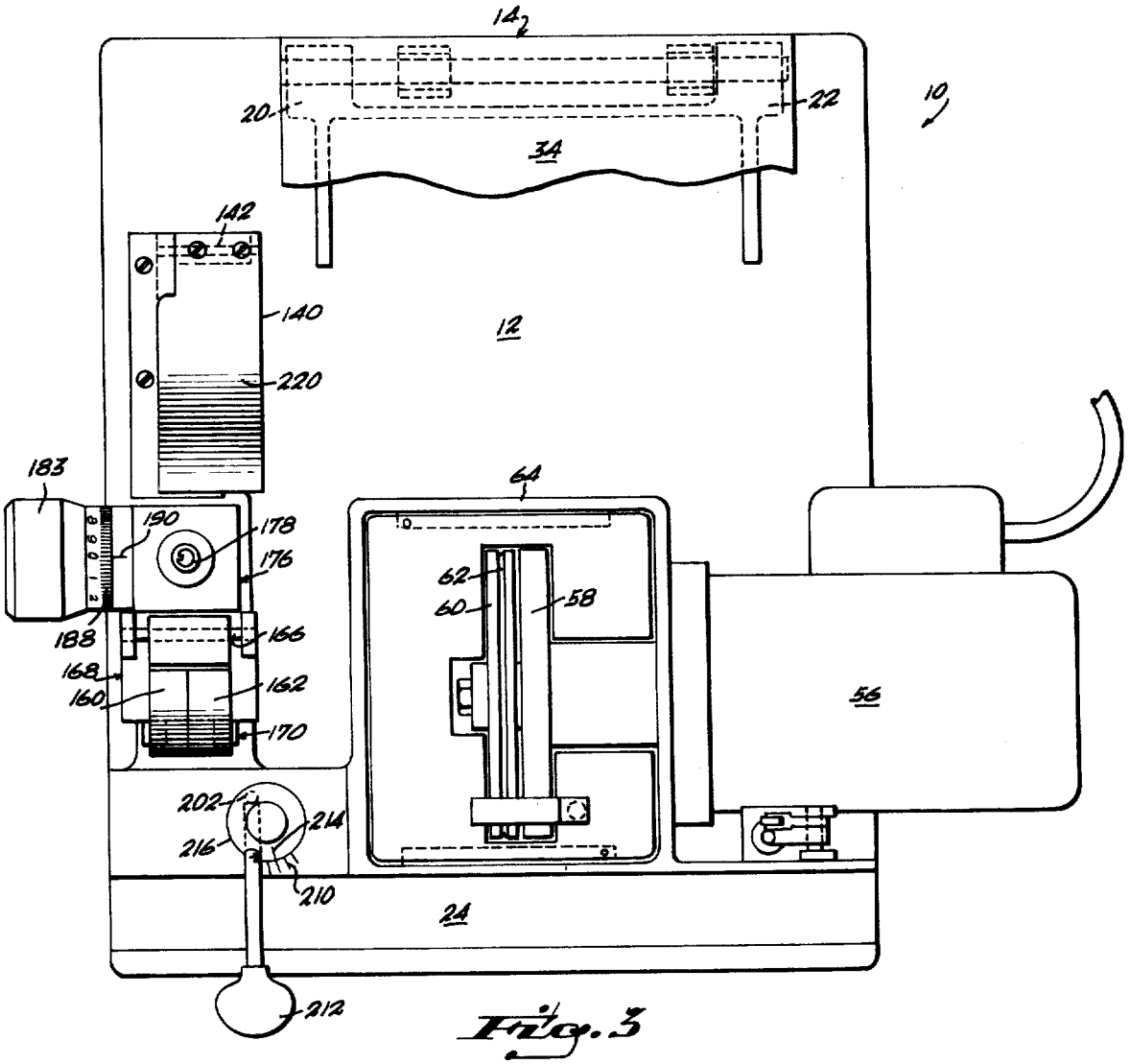
FIG. 3 is a top plan view of the device with the major portion of the top lens carriage plate broken away.

As best seen in FIGS. 2 and 3, an electric motor 56 is mounted to base 12 which rotatably powers a pair of grinder wheels, a first grinder wheel 58 with a flat annular surface and a second, beveling grinder wheel 60, provided with a V-groove 62 about its peripheral face. The grinder wheels are boxed in as at 64 to trap the dust accumulation from the grinding operation.

A gear motor 66, FIG. 2, is fixed as at 68 to a vertically extending plate 70, fixed to the carriage skirt 38 by attachment means 72. Generally indicated at 74 is a gear tram which connects from the drive shaft 76 of gear motor 66 to a cam follower assembly 78, to be subsequently described in detail, and a sprocket and chain drive assembly 80 to a first shaft 82 of the lens chuck assembly 84. A second shaft 86, FIG. 2, of the lens chuck assembly 84 is driven at the same speed as shaft 82 by a pair of sprocket and chain drive assemblies 88, 90, carried on the underside of lens carriage 14, through a common shaft 92, rotatably journaled in a pair of brackets 94, 96 fixed by attachment means 98 to carriage 14.

First shaft 82 of the chuck assembly is rotatably journaled through thickened portions 100 of the lens carriage 14 and terminates in a female chuck portion 102 within a cut-out 104 the grinder discs 58, 60. A second chuck portion 106 is carried on the confronting end of a second shaft 86. The lens engagement in chuck assembly 84 is accomplished in a conventional manner and is not illustrated in detail. A male member is properly positioned and adhesively secured to a lens blank B, and is inserted in the female chuck portion 102, the chuck portion 106 is formed of a somewhat resilient material and is moved inwardly against the convex side of the blank B by a pnuematic cylinder assembly 108, the piston of which is fixed in axial alignment with shaft 86. The pneumatic cylinder and piston assembly may be any of a variety of commercially available types. As illustrated the switch button 32 actuates an air control valve (not shown) to the cylinder to engage the lens blank B between chuck members 102, 106. However, another type of usable pneumatic cylinder assembly incorporates a cylinder, piston, control valve, pressure gauge and switch in a single unit. It should also be noted that the pneumatic operation may be replaced by appropriate commercially available hydraulic or electrical devices.

Figure 4:
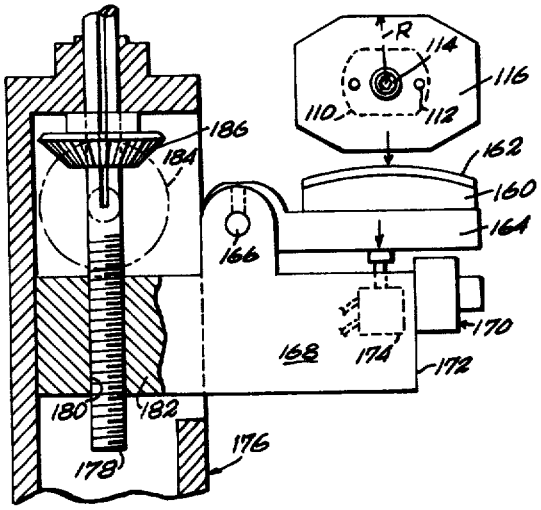
FIG. 4 is an enlarged fragmentary side view of a portion of FIG. 1, partially in section, illustrating the switch adjustment means associated with a lens template carried by the chuck drive shaft.

As best illustrated in FIGS. 2 and 4, the chuck shaft 82 terminates in a fitting 110 at its outer extended end. Fitting 110 is provided with a pair of locating pins 112 and a central screw 114 for attachment of a lens template such as the octagonal template 116 illustrated. Any shape or size template can be so attached to control the edge and bevel grinding operations in a manner hereinafter described.

Figure 7:
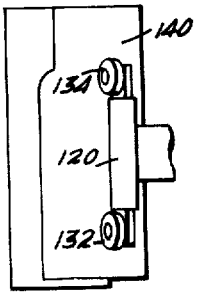
FIG. 7 is a schematic top plan view illustrating the cam operation during the edge grinding operation.

The cam follower assembly 78, FIGS. 1 and 2 as above described, is driven through gear train 74 by gear motor 66 to rotate a cam follower arm 120 centrally fixed by locating pins 122 and screw 124 relative to a drive gear 126 of gear train 74. As best illustrated in FIGS. 1, 2 and 7, both ends of arm 120 respectively terminate in outwardly extending lugs 128, 130 which are angled relative to the plane of rotation of arm 120. Cam follower rollers 132, 134 are rotatably attached at 136, 138 to the respective angled lugs 128, 130.

FIG. 1 illustrates the cycle start position of the arm 120 in which said arm defines a prop for the lens carriage plate 14, the only other attachment to the base 12 being the pivot rod 54. One follower roller 132 engages the top surface of an appropriately configurated cam plate 140. Cam plate 140 is pivotally attached at 142 at a first end to an upwardly extending housing 144 from base 12 and stop means 146 is provided at a second end to support the cam plate 140 in a downward limit of movement. In this position an electric switch 148 is in contact with cam plate 140 and is in an "on" position and being in the circuit with the cycle switch 30, the cycle motor 66 is energized when the cycle switch 30 is actuated to cause counterclockwise rotational movement of follower arm 120. A limit switch 150 is carried on plate 70 in a position to be operated by a pin 152 on gear 126 to an "off" position after one complete rotation of drive gear 126 and cam follower arm 120. The gearing provided by the cycle gear motor and gear train 74 being such that the gear 126 and arm 120 complete one complete revolution in a predetermined period of time, 48 seconds by way of example.

Means are provided to position a pair of template contact pads 160, 162, FIGS. 1, 2 and 4, fixed to a base member 164, pivotally carried at 166 on a vertically adjustable switch carriage 168. Stop means 170 are fixed to a front face 172 of the carriage 168 to limit downward pivotal movement of base member 164. An electric switch 174 disposed in the carriage 168, is in parallel with the cam plate actuated switch 148 for a purpose to be subsequently described to the operation of the device. The switch 174 is operated to an "on" position when the base member 164 is depressed.

Switch carriage 168 is vertically adjustable in a tower 176 extending upwardly from the base 12, by means of a vertical screw rod 178, FIG. 4, in threaded engagement with a threaded bore 180 in an inner extension 182 of carriage 168. A rotatable hand knob 183 carried on the upper end of tower 176 is provided with a bevel gear 184 in mesh with a bevel gear 186 slidably keyed to an upper end portion of screw rod 178. Hand knob 183 is provided with millimeter markings 188 for selective setting relative to a reference mark 190. As will be hereinafter apparent, it is necessary to adjust the positioning of template contact pads 160, 162 relative to the lens being ground.

Figure 10:
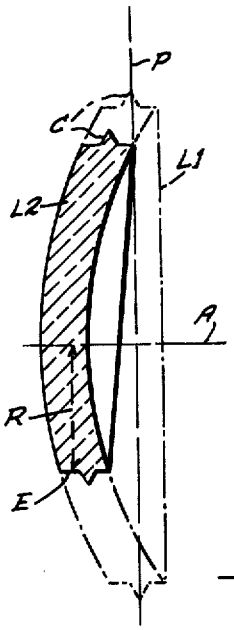
FIG. 10 is a substantially enlarged cross sectional view through a typical shaped, beveled lens to illustrate the everchanging lateral displacement of the bevel thereon.

With reference to FIG. 10, it can be seen that the bevel C on a round lens L1 will lie in a plane P completely about the circumference thereof. However, on all other lens configurations, for example L2, there is a constant deviation from such a plane because of the semi-spherical configuration in cross section. The position of the bevel C deviates or changes in direct relation to the length of the radius from the axis A to every point about the periphery.

Figure 11:
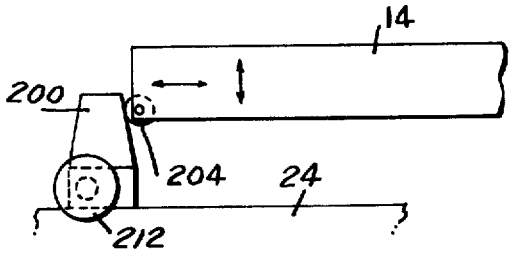
FIG. 11 is a schematic illustration of a truncated cone adjustably fixed to the base of the device and a follower roller carried by the lens carriage to compensate for the lateral displacement during the beveled operation.

To compensate for this deviation, a truncated cone 200, FIGS. 1 and 2, is eccentrically pivoted at 202 atop the front wall 24 in a position for contact by a follower roller 204, journaled at 206 in the edge of the lens carriage. As will be seen from the following description of the operation of the device, the front end of the lens carriage will move up and down in direct relation to the changing radius R. With the follower roller in contact with the sloping surface of cone 200 at all times, FIG. 11, the lens carriage will move laterally back and forth in direct proportion to the amount of up and down pivotal movement and maintain the bevel C at all times in a constant position relative to the edge E of the lens.

A plurality of lines 210 are provided on the top of front wall 24 adjacent the truncated cone 200. By selectively pivoting the cone by means of handle 212 about the fixed eccentric pivot 202 and aligning a reference mark 214 on the cone base 216 with one of the lines 210, the position of the bevel C may be varied relative to the lens edge E, that is, the bevel may be formed anywhere between front and rear portions of the edge E. The inner end of handle 212 is screw-threaded to permit its being tightened or locked relative to pivot 202 for adjustment purposes.

In operation, a lens blank B is engaged in the chuck 84 by means of the pneumatic cylinder and piston in a spaced above position over the grinder discs 58 and 60 for the start of the cycle, the cam follower arm 120 acting as a prop. The grinder motor 56 is energized by switch 28 and the cycle start switch 30 is actuated to energize the cycle motor 66 which initiates a counterclockwise movement of arm 120. The cycle circuit is initially maintained by switch 148. In its first stage of rotation the cam follower roller 132, FIG. 5, tracks across the raised center portion 220 of cam plate 140 along the angular path of arrow 222. This angular path defines a predetermined amount of lateral movement imparted to the lens carriage 14 along the pivot rod 54 to position the lens blank B over the edge grinder 58 as in FIGS. 5 and 6.

Figure 8:
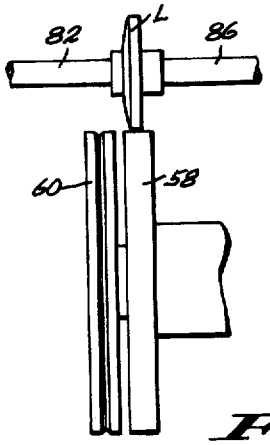
FIG. 8 is a schematic front elevational view similar to FIG. 6 illustrating the grinding operation with the cam follower positioned as in FIG. 7.

At this point, the follower arm roller 132 continues its rotation on arm 120 breaking contact with the cam plate 140 and the grinding operation commences as the lens carriage 14 pivots downwardly, see FIG. 8. Simultaneously, the lens template contacts pads 162 and becomes the prop for the lens carriage. The electric switch 174 is operated by the base member 164 to maintain the cycle circuit because the cam plate switch 148 is open as the roller continues to rotate free of cam plate 140 with arm 120 as in FIG. 7. During this period, with the base member 164 resting on the stop means 170, the template 116 lies on the pad 162 and is rotated under a substantial portion of the weight of the lens carriage. During this period of somewhat less than one-half of a rotation of the cam follower arm the edge grinding operation follows the contour of template 116 and the lens in the chuck is ground to the exact configuration thereof. This occurs in approximately 20 seconds, by way of example.

As the follower arm continues to rotate counterclockwisely from the position of FIG. 7, the opposite cam follower roller 134 contacts the cam plate 140 and again roller arm 120 acts as a prop, raising the lens carriage 14 and roller 134 tracks along a path in the angular direction of arrow 224 to laterally shift the ground lens to a position over the bevel grinder wheel. The follower roller 134 breaks contact with the surface of cam plate 140 as it begins the second half of one revolution and the lens carriage is lowered to follow the template 116 which is then positioned to bear against pad 160. It should be noted that pad 160 is lower than pad 162 a distance equivalent to the depth of the bevel. This permits the removal of enough additional material from the lens edge to define the bevel. Alternatively, the edge grinder wheel may be lesser in diameter than the beveling wheel an amount equal to the depth of the bevel. In this instance the pads 160, 162 could be coplanar.

Figure 5:
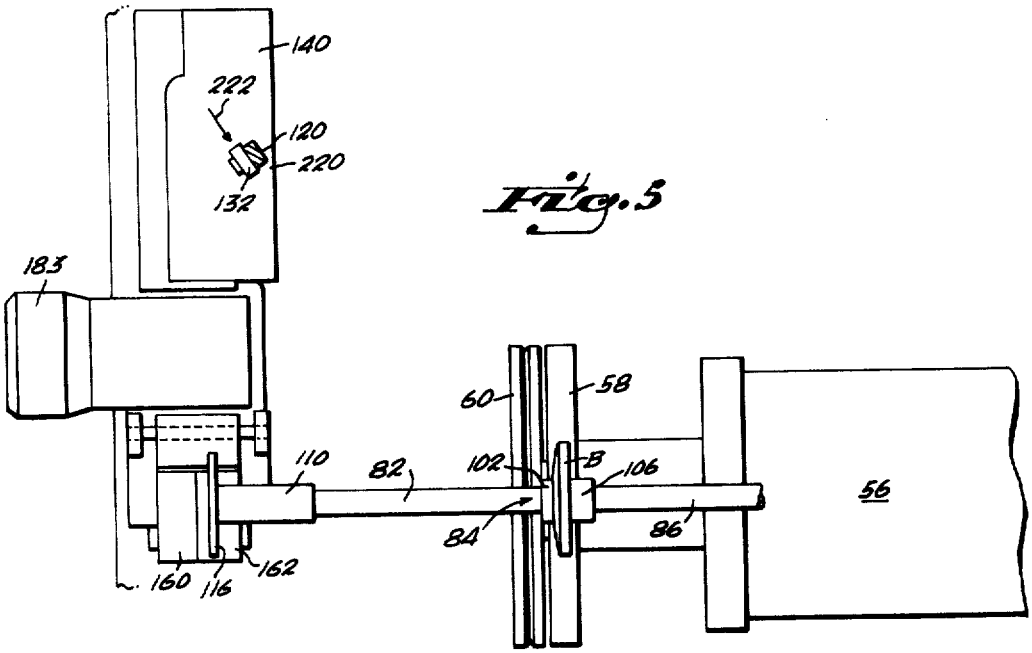
FIG. 5 is a schematic top plan view illustrating the cam operation to position a lens blank above the edge grinder wheel.
Figure 6:
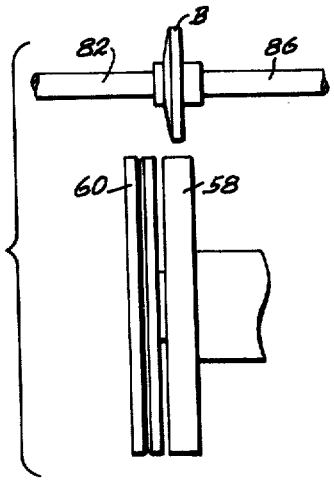
FIG. 6 is a schematic front elevational view illustrating the relation of the lens blank to the edge grinder wheel of FIG. 5.
Figure 9:
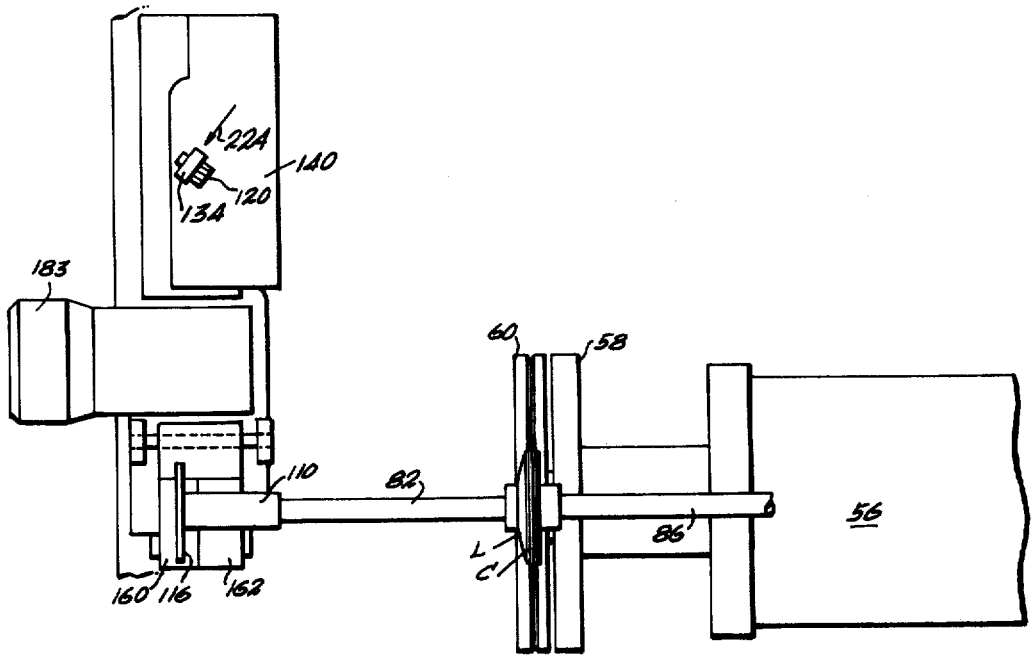
FIG. 9 is a schematic top plan view similar to FIG. 5 illustrating the cam operation to position a lens ground to a proper shape and size above the bevel grinder wheel.

It is noteworthy that the follower rollers 132, 134 though angled the same as particularly evidenced by FIGS. 2 and 7, being on opposite ends of the centrally pivoted arm 120, however, produces a situation whereby they are oppositely angled as they pass any common point during each cycle, FIGS. 5 and 9. As a result, they contact the cam plate 140 in oppositely angled positions, thereby shifting the carriage plate alternately in opposite directions.

At the end of each cycle, the follower roller 132 engages the cam plate 140 and pin 152 actuates limit switch 150. Cycle motor 66 is thereby de-energized with the lens carriage elevated for removal from the chuck of the finished lens and the insertion of another lens blank for the next grinding operation.

A protective shock absorbing means 230, FIG. 2, is provided as a safety means to absorb the shock if the lens carriage 14 is dropped or lowered too rapidly. Means 230 comprises a cylinder 232 loaded with a spring 234 engaged by a piston 236. The piston rod 238 from piston 236 is connected at 240 to a pair of arms 242, 244, fixed together at extended ends and pivotally pinned at 246 to a fixed arm 248 from cylinder 232. A roller 250 is carried at the upper end of arm 244 in a position to be engaged by the underside of the lens carriage 14 as it descends. This device performs no function in the lens grinding operation but, as stated, is simply a safety device.

In practice, means are provided to direct a stream of water on the grinder wheels during the lens grinding operation. This, however, is conventional in the art, forms no part of the present invention, and is not illustrated.

It should be noted that the cycling cam of the present invention may be applied to devices other than optical lens grinders requiring a like or similar cyclical movement.

What is claimed is:

1. A cycling device for sequentially positioning a work carriage relative to a pair of work stations from a start position and returning to the start position at the end of each cycle comprising, a main base including a pivotal, sliding connection to the work carriage to permit said carriage to pivot up and down relative to said base and to reciprocate in directions at right angles to said pivot movement, a predetermined amount, an appropriately configurated cam plate mounted to said base, a cam follower arm having oppositely extending ends positioned above said cam plate, and drive means centrally fixed thereto to rotatably drive said arm at a predetermined rate of speed, said drive means being fixed to said work carriage, first and second cam followers carried at the respective ends of said arm, each portion of said arm from said drive means connection being of a predetermined length so as to permit its associated cam follower to engage said cam plate for a predetermined portion of each revolution to cause an up and down pivotal movement of said carriage about said connection, said first cam follower being angled relative to a plane of rotation of said arm in a manner so as to permit it to track angularly across said cam plate in a first direction, when engaged therewith, to laterally slide said carriage into a position to align a piece of work carried by said work carriage with a first of said work stations at the beginning of said down movement, said second cam follower causing said up movement during a first portion of said cam plate engagement and being angled relative to the plane of rotation in a manner so as to cause it to track across said cam plate in a second direction, when engaged therewith, to laterally slide said carriage to align the piece of work with a second of said pair of work stations.

2. The device as defined in claim 1 wherein said drive means comprises an electric cycle motor and speed reduction means connecting between said cycle motor and arm.

3. The device as defined in claim 2 including a cycle start switch to said motor, and a limit switch to de-energize said motor at the end of a cycle.

4. The device as defined in claim 3 wherein said limit switch is positioned to end a cycle with said arm in a generally right angular position relative to said cam plate, whereby said arm and cam followers define a prop to hold said work carriage in an up position.

5. The device as defined in claim 3 wherein one revolution of said arm and cam followers comprises one cycle.

6. The device as defined in claim 5 wherein said pivotal sliding connection of said work carriage to said base is along a first end thereof, and including chuck means rotatably mounted inwardly of a second end thereof for engagement of an optical lens blank to be sized, shaped and beveled.

7. The device as defined in claim 6 including a drive connection from said chuck means to said cycle motor.

8. The device as defined in claim 7 wherein said drive connection comprises a chain and sprocket drive connecting to a first shaft carrying a female portion of said chuck means at an inner end thereof.

9. The device as defined in claim 8 including a second shaft, in axial alignment with said first shaft, carrying a chuck clamp portion of said chuck means for clamping and unclamping a lens blank between said female portion and clamp portion.

10. The device as defined in claim 9 including a reversible drive means for said clamping and unclamping operations.

11. The device as defined in claim 10 wherein said reversible drive means comprises a pneumatic cylinder and piston means, axially connected to an extended end of said second shaft and including means to actuate said piston.

12. The device as defined in claim 9 including a lens template and means to connect said template to an extended end of said first shaft, and adjustably fixed means to engage the peripheral edge of a lens template so connected during two intermediate periods of each cycle when said cam followers are disengaged from said cam plate.

13. The device as defined in claim 12 including a pair of grinder wheels rotatably journaled relative to said main base beneath said chuck means for sequential engagement, during said intermediate periods, by a lens blank engaged in said chuck means.

14. The device as defined in claim 13 including a relatively high speed electric motor operably connected to said grinder wheels for rotational operation thereof and an on-off switch therefor.

15. The device as defined in claim 14 wherein a first of said grinder wheels, defining said first work station, is provided with a flat peripheral surface for engagement by said lens blank during a first of said intermediate periods to size and shape the lens blank in accordance with the size and shape of said template.

16. The device as defined in claim 15 wherein a second of said grinder wheels, defining said second work station, is provided with a grooved peripheral surface for engagement by said sized and shaped lens during a second of said intermediate periods to form a peripheral bevel thereabout.

17. The device as defined in claim 16 wherein said adjustably fixed means comprises an abutment means, pivotally attached to a carriage member and a first stop means to limit downward pivotal movement of said abutment means.

18. The device as defined in claim 17 including a vertical screw shaft threaded through a threaded bore in an extended end of said carriage member within a vertical tower, extending upwardly from said base.

19. The device as defined in claim 18 including an adjustment knob operably connected to said screw shaft by appropriate gear means to provide for vertical adjustment of said abutment means.

20. The device as defined in claim 19 including centimeter and millimeter calibrations on said knob for selective alignment with a fixed reference mark.

21. The device as defined in claim 17 wherein said cam plate is pivotally attached relative to said main base along a first edge, and including a second stop means, adjacent a second, opposed edge, to limit downward pivotal movement thereof.

22. The device as defined in claim 21 including a first and second electric switch means in parallel between said cycle start switch and cycle motor.

23. The device as defined in claim 22 in which said first switch means is positioned relative to said cam plate to maintain an electric circuit to said cycle motor when said cam plate is held against said second stop means, and said second switch means is positioned relative to said abutment means to maintain an electric circuit to said cycle motor when said abutment plate is held against said first stop means.

24. The device as defined in claim 23 wherein said abutment means includes first and second, side-by-side abutment portions for respective engagement by said template when said lens is aligned with said first and second grinder wheels.

25. The device as defined in claim 24 wherein a top template contact surface of said second abutment portion is lower than a like template contact surface of said first abutment portion a distance at least equal to the depth of said bevel.

26. The device as defined in claim 24 wherein the diameter of said first grinder wheel is less than the diameter of said second grinder wheel an amount at least equal to the depth of said groove in said second grinder wheel.

27. The device as defined in claim 16 including a conical shaped member with adjustable attachment means mounted relative to a top end of a front wall, extending upwardly from said main base, and a follower roller fixed to said lens carriage a position for contact with the conical surface of said conical shaped member during said up and down movement of said lens carriage when said lens is positioned in alignment with said second grinder wheel.

28. The device as defined in claim 27 wherein said adjustable attachment means comprises a pivot pin fixed vertically in the top of said wall with said conical member eccentrically carried thereon, and a generally fowardly extending handle threaded into said conical member in a manner whereby said handle may be tightened or loosened relative to said pivot pin.

29. The device as defined in claim 28 including a plurality of spaced apart markings in said front wall top and a reference line on a bottom portion of said conical member for selective alignment with said plurality.

30. The device as defined in claim 1 including a shock absorber means mounted to said base, adjacent a front end thereof, to absorb the shock of a too rapid downward pivotal movement of said carriage.

31. The device as defined in claim 30 wherein said shock absorber means comprises a spring loaded cylinder and piston assembly, an outwardly upwardly extending piston rod extension, arm means pivotally connected between a cylinder extension and said piston extension in a manner whereby the shock of a sudden lowering of said carriage against an upper end of said arm means will be absorbed by said spring loaded cylinder and piston assembly.

* * * * *